United States Patent [19]

Kuji et al.

[11] Patent Number: 5,049,335

[45] Date of Patent: Sep. 17, 1991

[54] METHOD FOR MAKING POLYCRYSTALLINE FLAKES OF MAGNETIC MATERIALS HAVING STRONG GRAIN ORIENTATION

[75] Inventors: Toshiro Kuji, Agro, Japan; Robert C. O'Handley, Andover; Nicholas J. Grant, Winchester, both of Mass.

[73] Assignee: Massachusetts Institute of Technology, Cambridge, Mass.

[21] Appl. No.: 301,868

[22] Filed: Jan. 25, 1989

[51] Int. Cl.[5] ..... B02C 4/02; B22D 11/00; B28B 3/12

[52] U.S. Cl. ..... 264/140; 164/460; 164/463; 425/363

[58] Field of Search ..... 264/140, 8; 425/363, 425/315; 164/463, 460

[56] References Cited

U.S. PATENT DOCUMENTS

| | | | |
|---|---|---|---|
| 884,571 | 4/1908 | Cowing | 264/140 X |
| 1,780,201 | 11/1930 | Martin | 264/140 X |
| 3,859,407 | 1/1975 | Blanding et al. | 264/140 X |
| 4,063,942 | 12/1977 | Lundgren | 264/8 X |
| 4,116,601 | 9/1978 | Lehmann et al. | 425/363 X |
| 4,154,284 | 5/1979 | Maringer | 264/8 X |
| 4,202,089 | 5/1980 | Ljung | 164/463 X |
| 4,215,084 | 7/1980 | Maringer | 264/8 |
| 4,238,427 | 12/1980 | Chisholm | 264/82 X |
| 4,552,199 | 11/1985 | Onoyama et al. | 164/463 X |
| 4,687,510 | 8/1987 | Cheney et al. | 264/82 X |
| 4,810,309 | 3/1989 | Coehoorn et al. | 164/463 X |
| 4,810,572 | 3/1989 | Ooe et al. | 264/271.1 X |

FOREIGN PATENT DOCUMENTS

| | | | |
|---|---|---|---|
| 47-50486 | 12/1972 | Japan | 264/140 |
| 48-00367 | 1/1973 | Japan | 264/140 |
| 48-33839 | 10/1973 | Japan | 264/140 |

OTHER PUBLICATIONS

Buflovak Flakers "A Continuous Process for Cooling and Flaking Chemicals", Blaw-Knox Co. Catalog #370, Jan. 1964, pp. 1-16.

*J. Appl. Phys.*, 55 (6) (Mar. 1984): Sagawa, M., et al., "New Material for Permanent Magnets on a Base of Nd and Fe (invited)".

*IEEE Transactions on Magnetics* (21:No. 5) (Sep. 1985). Lee, R. W., et al., "Processing of Neodymium-Iron-Boron Melt-Spun Ribbons to Fully Dense Magnets".

*IEEE Transactions on Magnetics*, vol. Mag-23, No. 5 (Sep. 1987) "The Texture of Melt Spun $Fe_{76}Nd_{16}B_8$ Ribbons".

*IEEE Transactions on Magnetics*, vol. Mag-21, No. 5 (Sep. 1985) "Highly Heat-Resistant Nd-Fe-Co-B System Permanent Magnetics".

IEEE Transactions on Magnetics, vol. Mag-22, No. 5, (Sep. 1986) "Fe-Nd-B Permanent Magnets Made by Liquid Dynamic Compaction".

*Mat. Res. Soc. Symp. Proc.*, vol. 96, (1987), "Optimization of Liquid Dynamic Compaction for Fe-Nd-B Magnetic Alloys".

*J. Appl. Phys.*, 59(4) (Feb. 1986), "(FeCo)-Nd-B Permanent Magnets by Liquid Dynamic Compaction".

*Primary Examiner*—Jan H. Silbaugh
*Assistant Examiner*—Karen D. Kutach
*Attorney, Agent, or Firm*—Choate, Hall & Stewart

[57] ABSTRACT

A magnetic material melt is solidified by cooling the material from two opposing surfaces while deforming the material by applying compressive pressure to the two opposing surfaces. Twin roller quenching is a preferred method for producing the flakes. The flakes exhibit strong texture normal to their surface, that is, there is a high degree of alignment of the magnetically easy axes of the crystals within the polycrystalline flake. The strong crystal orientation appears to result both from directional solidification in a thermal gradient and uniaxial deformation of the solid phase in the twin rollers. Magnetization studies on individual flakes show intrinsic coercivities of 14 kOe and a nearly 50% higher remanance for field normal to the flake surface than in the flake plane. Splat quenching is another suitable technique for carrying out the invention.

17 Claims, 3 Drawing Sheets

METHOD FOR MAKING POLYCRYSTALLINE FLAKES OF MAGNETIC MATERIALS HAVING STRONG GRAIN ORIENTATION

The Government has rights in this invention pursuant to U.S. Army Research Office Contract No. DAAG-84-K-1701.

BACKGROUND OF THE INVENTION

The present invention relates to method and apparatus for making polycrystalline flakes of magnetic materials having strong grain orientation.

It is known how to make permanent magnets from a $Fe_{77}Nd_{15}B_8$ alloy. Non-oriented, rapidly solidified magnets made from melt spun ribbon without uniaxial deformation or by liquid dynamic compaction techniques are substantially isotropic in their grain orientation and magnetic properties. They therefore exhibit relatively low remanance and low maximum energy product. Their technical value is thus limited.

Oriented Nd-Fe-B permanent magnets can be produced by alignment of single grain particles of primary phase, $Nd_2Fe_{14}B$. Two different alignment processes have been reported in the literature: compaction of milled powder in a magnetic field, see, M. Sagawa et al., J. Appl. Phys., 55(6), 2083 (1984); and hot uniaxial deformation of rapidly solidified materials, see, R. W. Lee et al., IEEE Transactions on Magnetics, Vol. MAG-21, No. 5, 1958 (1985). The hot deformation of rapidly solidified materials aligns the easy magnetization axes of the individual crystals within a polycrystalline material. Dadon et al., IEEE Transactions on Magnetics, Vol. MAG-23, No. 5, 3605 (1987) have observed a preference for tetragonal c axis (magnetically easy axis) orientation normal to the surface of melt spun ribbons (single-roller quenching) but no magnetic measurements were reported.

The milled powder technique requires that the powder be milled to very small particle sizes to produce substantially single crystal particles which are then aligned in a magnetic field. This technique thus requires fine milling of master alloys, the handling of very reactive powders, as well as the separate compacting and sintering stages.

SUMMARY OF THE INVENTION

According to the invention, magnetic material is solidified by cooling it from two opposing surfaces while deforming the material by applying compressive pressure to the two opposing surfaces. In preferred embodiments, the material is solidified and deformed by twin roller quenching or splat quenching. Suitable magnetic materials are $Nd_{15}Fe_{77}B_8$ and $BaO.6Fe_2O_3$. The invention, of course, is applicable to many magnetic materials such as any composition in the Nd-Fe-B systems as well as in related systems, i.e., rare earth element(s)-Fe-B systems. In particular, the invention is applicable to $R_xT_yM_{100-x-y}$ where R is mostly Nd or Pr and may include a few atom percent of Ce, Sm, and other rare earths, $12 \geqq x \geqq 8$; T is mostly Fe and may include a few atom percent of Co, Ni, Mn, Cr, or other transition metals, $65 \geqq y \geqq 80$; and M is mostly boron but may include C, Si, P, and other metalloids. The invention may also be practiced with a material that is substantially barium hexaferrite, cobalt ferrite, or other hard magnetic oxides. Another suitable material is $T_nR$ where T is mostly Co but may include some Fe, Ni, Cu, Mn, or other transition metal, $4.5 \geqq n \geqq 5.5$, and R is mostly Sm but may include other early rare earth species. Yet another material suitable for the practice of the present invention is $T_mR_n$ where T is mostly Co but may include Fe, Ni, Cr, or other transition metals, $15 < m < 19$, and R is mostly Sm but may include other early rare earth species and $1.5 \leqq n \leqq 2.5$.

The polycrystalline flakes produced by the method of the invention exhibit a strong microcrystalline texture (c-axis normal to flake plane) and hence strong magnetic anisotropy so that the flakes do not have to be fine-milled to single grain size (2–5 μm) to be aligned in a magnetic field. Relatively large multigrain particles of these twin roller materials can be aligned because of the strong alignment of their grains that results from the process. The ability to align relatively large flakes (20–60 μm) of twin roller quenched material avoids the need to introduce special low oxygen handling as is required by the 2–5 μm powders. Further, because of the high degree of alignment, the remanance and maximum energy product of the flakes are much higher than those of any other rapidly solidified magnets which are generally isotropic. The materials of the invention can thus be used to make permanent magnets.

DESCRIPTION OF THE PREFERRED EMBODIMENT

Figure 1:
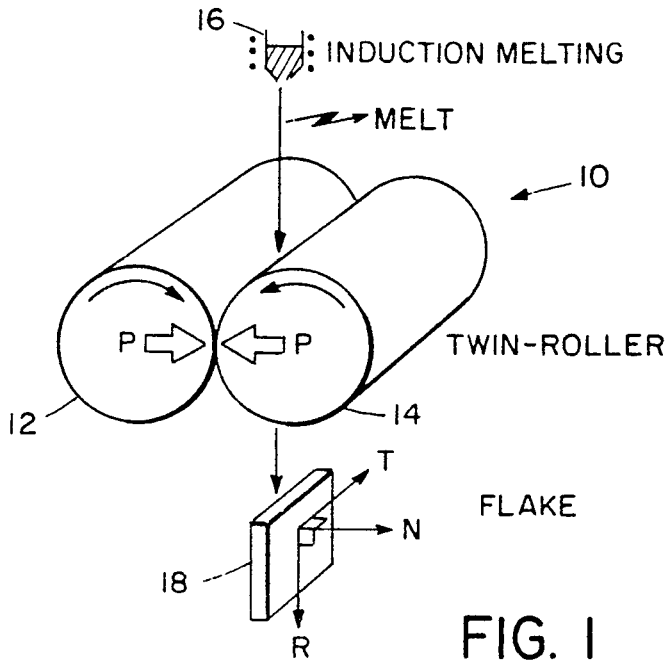
FIG. 1 is a schematic illustration of the method of the invention employing twin-roller quenching.

The composition of a suitable alloy for the practice of the present invention is $Nd_{15}Fe_{77}B_8$, Other suitable magnetic materials are $Co_5Sm$, $Co_{17}Sm_2$ and barium hexaferrite. As noted above, the invention, of course, is applicable to many other magnetic materials. A starting ingot of $Nd_{15}Fe_{77}B_8$ was prepared by induction melting under an argon atmosphere. The flake samples were prepared by a twin roller quenching technique, also under an argon atmosphere. FIG. 1 shows a twin roller apparatus 10 which includes first and second rollers 12 and 14 pressed together by conventional apparatus such as springs (not shown). The rollers 12 and 14, 5.5 cm in diameter in this embodiment, are constructed of hardened tool steel and are spring loaded with a force of approximately 100 lbs. to maintain the rollers in contact. A suitable roller surface speed is 1.5 $ms^{-1}$. It is preferred that the rollers be pressed together with a pressure of 50 pounds or higher and that roller speed be in the range of 1:5 m/sec. to 30 m/sec. or higher.

The starting ingots were melted in a quartz tube 16 and then squirted through an orifice, 0.5 mm in diameter, at the bottom of the tube 16 to the point of contact between the counterrotating rollers 12 and 14. The molten alloy pool above the nip of the rollers is directionally cooled by the rollers from both sides and upon solidification is also hot deformed on passing through the rollers. This process results in flakes, typically 10–50 μm thick and up to a few millimeters on edge, such as a flake 18 drawn schematically. Flakes have also been observed having thicknesses up to 150 μm.

The magnetic properties of resulting flakes have been measured in three different directions as shown in FIG. 1, namely, normal to the flake surface (N-direction), transverse (T-direction), and along the roll direction (R-direction). Magnetic measurements were performed at the Francis Bitter National Magnet Laboratory using a low frequency vibrating sample magnetometer in fields up to 14 T. The crystallographic texture of the flakes was determined by X-ray diffraction on a Rigaku 300 rotating anode spectrometer using CuK α radiation.

Figure 2:
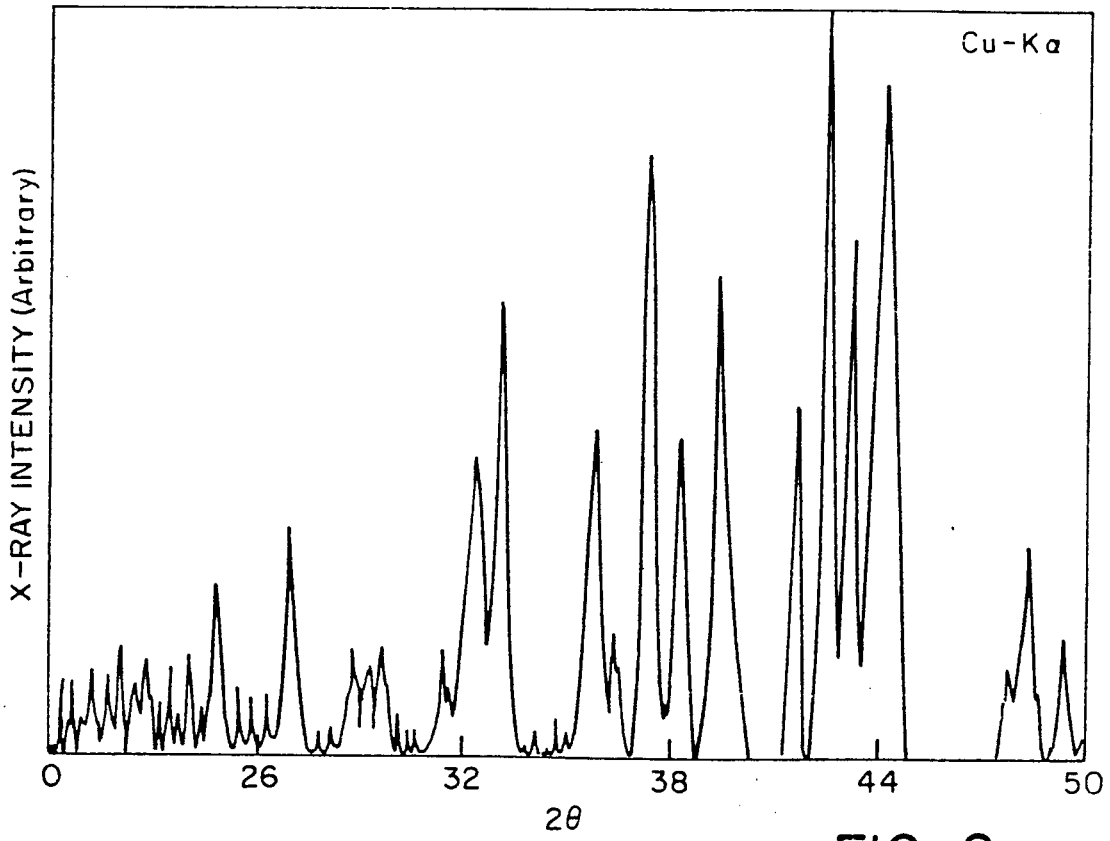
FIG. 2 is a graph of the X-ray diffraction pattern of ground flakes made by the method of the invention showing peak intensities typical of powder (non-oriented) Fe-Nd-B.
Figure 3:
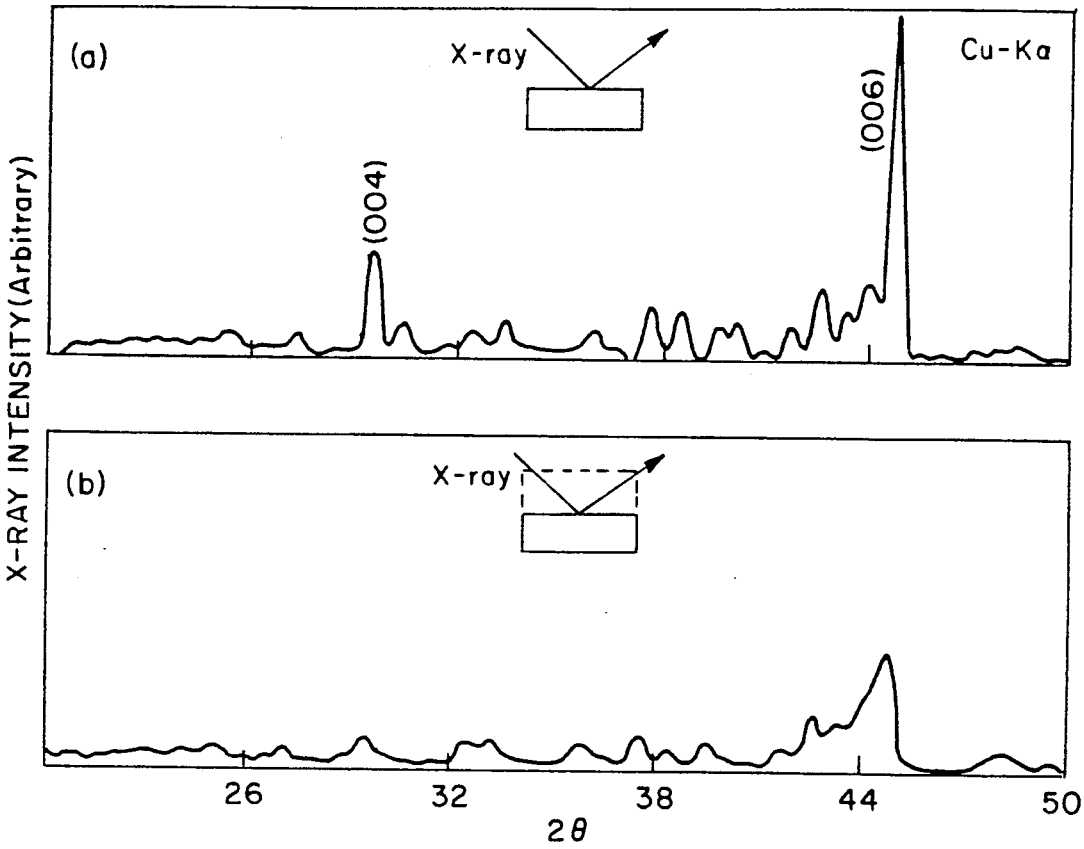
FIG. 3*a* is a graph of the X-ray diffraction pattern obtained from virgin flake surface of flakes made according to the invention.
FIG. 3*b* is a graph of the X-ray diffraction pattern obtained from polished surface of flakes made according to the invention.

FIG. 2 shows an X-ray diffraction pattern from ground flakes made according to the invention. The diffraction pattern resembles a typical $Fe_{14}Nd_2B$ powder diffraction pattern. See, M. Sagawa et al., J. Appl. Phys. 55(6), 2083 (1984): and Arai et al., IEEE Trans. Mag., Vol. MAG-21, No. 5 (1985). In FIG. 3, two X-ray patterns obtained from single flake surfaces are shown FIG. 3*a* is the pattern taken from a virgin flake surface. This pattern clearly shows very strong reflections with indices (006) and (004) which indicate that the tetragonal c-axis lies normal to the flake surface. Because of very weak penetration of X-rays into the metal, it was not clear that this texture existed throughout the flake thickness. Therefore the flake was polished to half its original thickness and an X-ray diffraction pattern was taken from the polished surface which is shown in FIG. 3*b*. The result indicates the strongest diffraction from (006) even though the degree of texture is less than that at the virgin surface shown in FIG. 3*a*. These results imply that tetragonal c-axis alignment occurs throughout the flake cross-section, from one surface to the other, though strongest at the surface.

Figure 4:
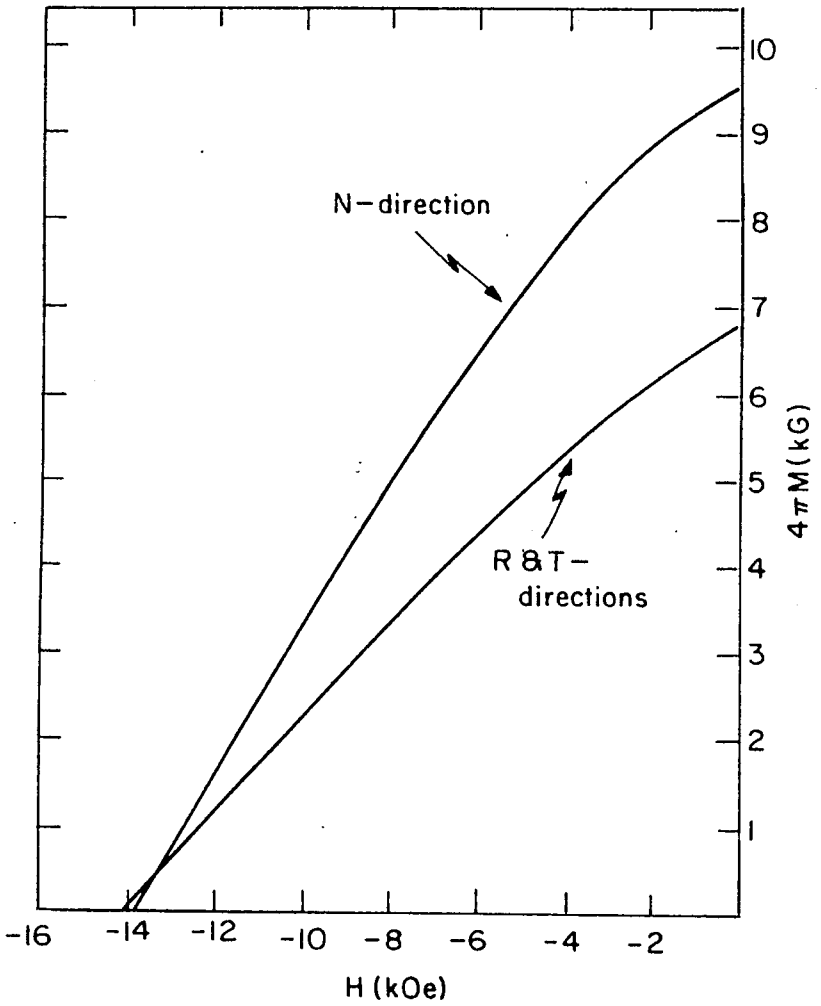
FIG. 4 is a graph showing demagnetization curves of flake made by the twin-roller technique of the invention.

As expected, the above X-ray results are clearly reflected in the magnetic anisotropy of the flakes. FIG. 4 shows the magnetization curves for the N, T, and R directions of the flake set forth in FIG. 1. Measured magnetic properties are summarized as follows:

| | N-direction | T & R-directions |
|---|---|---|
| Br(kG) | 9.5 | 6.5 |
| iHc(kOe) | 14 | 14 |
| (BH)max(MGOe) | 16 | 8 |

Figure 5:
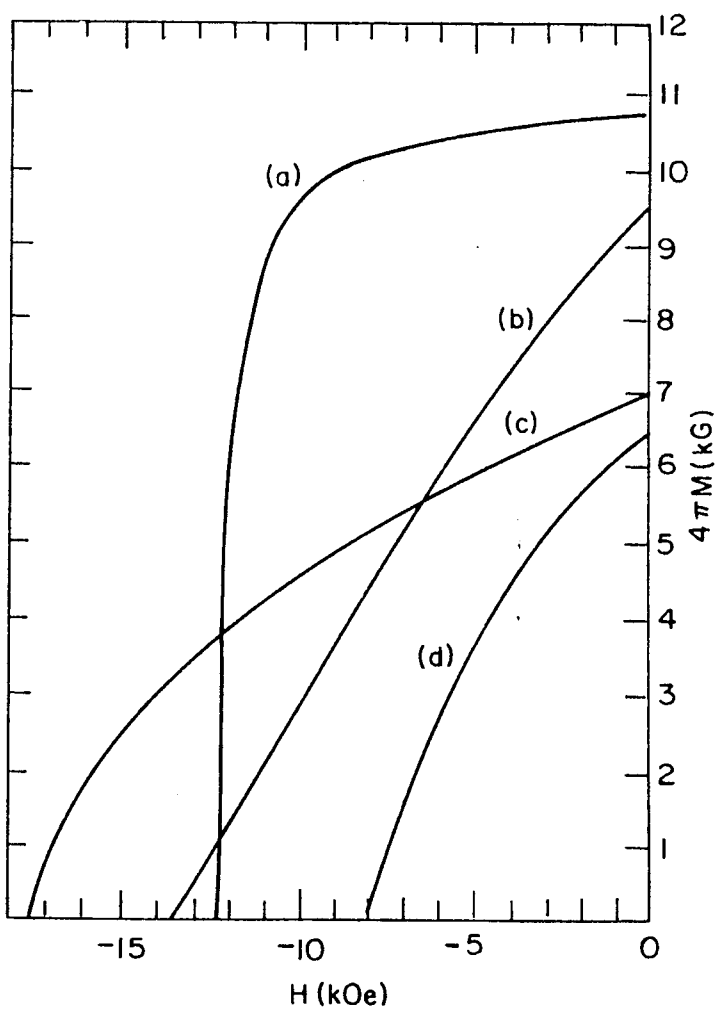
FIG. 5 is a graph showing demagnetization curves obtained from various processing techniques.

Note that the magnetic measurements confirm the X-ray diffraction studies indicating that the tetragonal c-axes (magnetically easy) are preferentially aligned in the N direction. For fully aligned thin sheets Br could approach 16 kG; for random alignment, $Br \leqq 5.3$ kG. (The best aligned sintered magnets show $Br \simeq 12$ kG.) The degree of alignment of flakes made according to the invention corresponds to a magnetic anisotropy energy density of $1.7 \times 10^6$ erg/cm$^3$. (For an isotropic array of particles this number would be zero.) Because of this degree of alignment, the remanance, $B_r$, and maximum energy product, $(BH_{max})$, of twin roller quenched flakes are much higher than those of any other rapidly solidified magnets which are generally isotropic. Rapidly solidified magnets with the approximate composition $Nd_{15}Fe_{77}B_8$ show $B_r = 7$ kG, $(BH)_{max} = 10$ MGOe for melt spun ribbon, see, J. Croat, Proceedings of the 2nd International Conference on Rapidly Solidified Materials, San Diego, edited by Peter W. Lee and John M. Moll (1988); and $B_r = 7$ kG. $(BH)_{max}8$ =MGOe for Liquid Dynamic Compaction (LDC), see, S. Tanigawa et al., IEEE Trans. MAG-22, 746 (1986) and Veistinen et al., Mat. Res. Soc. Symp. Proc., Vol. 96, 93 (1987). FIG. 5 shows demagnetization curves obtained from materials made by different techniques: (a) die-upset $Nd_{13}Fe_{82.6}B_{4.4}$ parallel to press direction, (b) flakes made by the present technique in the N direction, (c) isotropic $Nd_{15}Fe_{77}B_8$ melt-spun ribbons and (d) isotropic $Nd_{15}Fe_{77}B_8$ made by liquid dynamic compaction.

Figure 6:
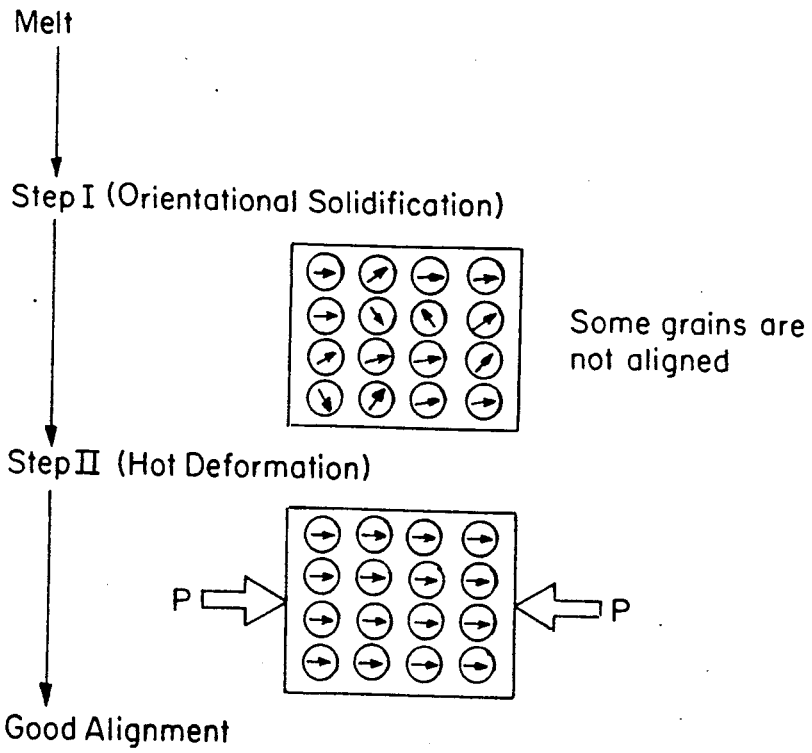
FIG. 6 is a schematic illustration of the method of the invention.

FIG. 6 is a flow chart which illustrates the present invention. Step 1 is an orientational solidification involving cooling from opposed surfaces. Note that some of the grains are not aligned. The orientational solidification is accompanied in step 2 by the hot deformation which results in good alignment. Those skilled in the art will appreciate that twin roller quenching is but one technique for practicing the invention. Another technique for achieving both directional cooling and hot deformation is splat quenching.

Assuming a negligible temperature gradient along the wheel surface, the orientational crystal growth may be associated with the large temperature gradient normal to the surface. It is generally the case in as-cast grain structures that the direction of easiest crystal growth (the tetragonal base plane in the present case) aligns with the direction of quickest solidification (along the isotherm). Those crystal nuclei favorably oriented with their tetragonal base along the isotherm grow at the expense of those not so favorably aligned. This situation accounts for the preferred c-axis normal to the flake surface. With single roller quenching, however, tetragonal c-axis alignment may not be achieved throughout the flake cross-section.

Melt spun rapidly quenched Nd-Fe-B ribbons that are subjected to uniaxial compression (hot pressing or die upsetting) show the tetragonal c-axis alignment parallel to applied load direction. Similarly, in the case of twin roller quenching according to the teachings of the present invention, the alignment of any solids formed with other than c-axis normal to the wheel surface may be achieved when the solidified Nd-Fe-B alloy is compressed between the two rollers. The flakes made by the twin-roller quenching technique of the present invention show a clear magnetic anisotropy caused by alignment of primary tetragonal phase, $Nd_2Fe_{14}B$. This magnetic anisotropy has been achieved by textured growth in a temperature gradient from two surfaces or by hot deformation of solidified particles or both.

What is claimed is:

1. Method for making from the molten state polycrystalline flakes of a magnetic material, the flakes having strong grain orientation due to a high degree of alignment of grains within the magnetic material comprising:

solidifying the molten magnetic material by cooling from two opposing surfaces of the magnetic material to provide partial alignment of the grains within the magnetic material, while deforming the magnetic material by applying compressive pressure to the two opposing surfaces of the magnetic material to provide the high degree of alignment of the grains within the magnetic material and thus form the flakes having strong grain orientation.

2. The method of claim 1 wherein the material is solidified and deformed by splat quenching.

3. The method of claim 1 wherein the material is substantially barium hexaferrite or cobalt ferrite or other hard magnetic oxides.

4. The method of claim 1 wherein the material is $Nd_{15}Fe_{77}B_8$.

5. The method of claim 1 wherein the material is barium hexaferrite.

6. The method of claim 1 wherein the material is $Co_5Sm$.

7. The method of claim 1 wherein the material is $Co_{17}Sm_2$.

8. The method of claim 1 wherein the flakes have a thickness in the range of approximately 10–100 microns.

9. The method of claim 1 wherein the material is solidified and deformed by twin-roller quenching.

10. The method of claim 9 wherein the twin rollers are pressed together with a pressure greater than 50 pounds.

11. The method of claim 9 wherein the surface speed of the twin rollers is approximately in the range of 1.5 meters per second to 30 meters per second.

12. The method of claim 1 wherein the material is $R_xT_yM_{100-x-y}$ where R is substantially Nd or Pr, $12 \leqq x \leqq 18$; T is substantially Fe, $65 \leqq y \leqq 80$; and M is substantially boron.

13. The method of claim 12 wherein R further includes a few atom percent of Ce, Sm, or other rare earths; T further includes a few atom percent of Co, Ni, Nm, Cr, or other transition metals; and M further includes C, Si, P, or other metalloids.

14. The method of claim 1 wherein the material is $T_nR$ where T is substantially Co, $4.5 \leqq n \leqq 5.5$, and R is substantially Sm.

15. The method of claim 14 wherein T further includes Fe, Ni, Cu, Mn, or other transition metals; and R further includes other early rare earth species.

16. The method of claim 1 wherein the material is $T_mR_n$ where T is substantially Co, $15 \leqq m \leqq 19$, R is substantially Sm, $1.5 \leqq n \leqq 2.5$.

17. The method of claim 16 wherein T further includes Fe, Ni, Cr, or other transition metals and R further includes other early rare earth species.

* * * * *

UNITED STATES PATENT AND TRADEMARK OFFICE

CERTIFICATE OF CORRECTION

PATENT NO. : 5,049,335

DATED : September 17, 1991

INVENTOR(S) : Toshiro Kuji, et al.

It is certified that error appears in the above-identified patent and that said Letters Patent is hereby corrected as shown below:

Column 1, line 61: Replace "$12 \geq x \geq 8$" with --$12 \leq x \leq 18$--.
line 63: Replace "$65 \geq y \geq 80$" with --$65 \leq y \leq 80$--.

Column 2, line 1: Replace "$4.5 \geq n \geq 5.5$" with --$4.5 \leq n \leq 5.5$--.

Column 3, line 29: After "shown" insert --.--.

Column 4, line 7: Replace "$(BH)_{max}8$=MGOe" with --$(BH)_{max}$=8MGOe--.".

Signed and Sealed this

Thirteenth Day of April, 1993

*Attest:*

*Attesting Officer*

STEPHEN G. KUNIN

*Acting Commissioner of Patents and Trademarks*